United States Patent [19]

Curran

[11] Patent Number: 4,976,336

[45] Date of Patent: Dec. 11, 1990

[54] LIFTING APPARATUS AND LIFTING ARM ASSEMBLY FOR USE THEREIN

[75] Inventor: Robert J. Curran, Mississauga, Canada

[73] Assignee: Derlan Manufacturing Inc., Mississauga, Canada

[21] Appl. No.: 243,861

[22] Filed: Sep. 13, 1988

[51] Int. Cl.[5] ..... B66F 7/04

[52] U.S. Cl. ..... 187/8.5; 187/8.67; 187/8.75; 187/8.77; 91/420; 91/520; 92/110

[58] Field of Search ..... 187/8.41, 8.49, 8.5, 187/8.74, 8.75, 8.77, 8.67; 91/420, 520; 92/110

[56] References Cited

U.S. PATENT DOCUMENTS

| | | | |
|---|---|---|---|
| 1,525,477 | 2/1925 | Hose . | |
| 1,684,607 | 9/1928 | Thielen . | |
| 1,944,351 | 1/1934 | Landry . | |
| 1,962,924 | 6/1934 | Bristol . | |
| 2,057,335 | 10/1936 | Hott . | |
| 2,331,108 | 10/1943 | Ganahl . | |
| 2,616,265 | 11/1952 | Wilson . | |
| 2,644,307 | 7/1953 | Blair . | |
| 2,765,626 | 10/1956 | Ashley et al. . | |
| 2,909,358 | 10/1959 | Southwick . | |
| 2,940,262 | 6/1960 | Pfitzenmeier . | |
| 3,143,924 | 8/1964 | Pearson et al. . | |
| 3,173,659 | 3/1965 | Hemmeter . | |
| 3,184,920 | 5/1965 | Lohbauer et al. . | |
| 3,355,993 | 12/1967 | Williamson . | |
| 3,476,016 | 11/1969 | Dixon et al. . | |
| 3,603,210 | 9/1971 | Flajorncic . | |
| 3,703,849 | 11/1972 | Renner et al. . | |
| 4,076,104 | 2/1978 | Bishop et al. | 187/8.5 |
| 4,212,449 | 7/1980 | Tsujimura . | |
| 4,423,664 | 1/1984 | Buchl | 91/520 X |
| 4,500,071 | 2/1985 | Bagwell et al. . | |
| 4,613,257 | 9/1986 | Weirich et al. | 91/520 X |
| 4,655,031 | 4/1987 | Kucera . | |
| 4,715,477 | 12/1987 | Suzuki | 187/8.75 X |
| 4,724,930 | 2/1988 | Vanlierop | 187/8.5 |
| 4,763,761 | 8/1988 | McKinsey et al. | 187/8.41 |
| 4,789,342 | 12/1988 | Shitanoki | 439/164 X |
| 4,825,977 | 5/1989 | Isogai | 187/8.75 X |

*Primary Examiner*—Andres Kashnikow
*Assistant Examiner*—Kenneth DeRosa
*Attorney, Agent, or Firm*—Rogers, Bereskin Parr

[57] ABSTRACT

A lifting apparatus has two posts on either side. A lifting or cross member extends between them and is supported on carriages slidably mounted on the posts. Support arms or the like extend out from the support carriages for supporting a vehicle or other load. Actuators are provided for driving the carriages up and down. The actuators can be hydraulic cylinders connected in a master and slave relationship with a hydraulic connection between them through the cross member. Additionally, mechanical safety catches can be provided which are connected by a cable or the like through the cross member, to permit a single handed operation of them. In the further aspect of the invention, a mechanism is provided for locking the support arms angularly, which mechanism includes plungers that contact the ground and automatically free the support arms when the apparatus is lowered.

19 Claims, 6 Drawing Sheets

LIFTING APPARATUS AND LIFTING ARM ASSEMBLY FOR USE THEREIN

FIELD OF THE INVENTION

This invention relates to an Hydraulic Lift, and more particularly is concerned with an hydraulic lift for vehicles.

BACKGROUND OF THE INVENTION

There are a number of earlier proposals in the patent literature for elevating devices for automobiles or other motor vehicles, namely U.S. Pat. Nos. 1,525,477 (Hose), 1,944,351 (Landry), 1,962,924 (Bristol), 2,057,335 (Hott), 4,212,449 (Tsujimura) and 4,500,071 (Bagwell et al.).

The Hose patent is the oldest of these and provides a four cylinder lift. The problem of ensuring uniform motion of the hydraulic cylinders is not adequately addressed. It is mentioned that if there is uneven raising of the cylinders, then of necessity this will balance when the cylinders reach their upper limit, since all cylinders must necessarily then be of the same height. Manually operable stops are provided, but no details are given of the mechanism of operating them.

The Landry patent whilst primarily concerned with a master and slave cylinder arrangement for use on a vehicle does suggest on page three that the invention is applicable to "elevatable vehicle racks for chassis lubrication". Check valves are provided, which are intended to ensure that the motion of the two cylinders is uniform.

Both the Bristol and Hott patents are concerned with lifts particularly for buses. As such, they provide a complex in-ground arrangement. The Bristol patent has a mechanical arrangement for sensing any variation of the rails from the horizontal. In the Hott patent, a complex valve arrangement is provided to ensure that the two cylinders operate uniformly.

The Tsujimura patent discloses an apparatus including hydraulic cylinders, but is primarily concerned with the arrangement of swing arms for lifting a vehicle by its chassis or body.

The Bagwell et al. patent presents some difficulty in interpretation. So far as it can be understood, it provides a lift having two hydraulic cylinders, with a hydraulic circuit including velocity valves for safety. To connect the cylinders together, an exposed hydraulic line extends across the top of the apparatus. This hydraulic line has to be higher then the top of the highest vehicle when in a fully raised position. As a consequence, the whole apparatus has to be of a considerable height. Additionally, the necessary lifting range is only achieved by effectively doubling the travel of each hydraulic cylinder with a chain arrangement.

The principle of a pair of hydraulic cylinders arranged in a master-slave relationship is well known, with the fluid displaced by the travel of the master cylinder being passed to the slave cylinder to actuate it. Thus, U.S. Pat. Nos. 2,616,265 (Wilson), 2,765,626 (Ashley et al.), 3,143,924 (Pearson et al), 3,184,920 (Lohbauer et al), 3,476,016 (Dixon et al) and 4,655,031 (Kucera) all disclose apparatus including a master-slave cylinder relationship. The Wilson patent is particularly concerned with ensuring that the master and slave cylinders move uniformly together To this end, a somewhat complex circuit is provided. The example shown is for an hydraulic press. Similarly, in the Ashley et al patent, an hydraulic mechanism is provided, including a somewhat complex arrangement of valves for controlling the motion of the master and slave cylinders. This again is in relation to an hydraulic press. Similarly, the Pearson et al patent is concerned with a control arrangement for master and slave cylinders of an hydraulic press.

The Lohbauer et al patent is concerned with a different field, namely the leakage control for a bulldozer pitch jack circuit. As such, it provides pilot-controlled valve for controlling the incoming pressure to the cylinders.

The Dixon et al patent discloses a scissor jack including master and slave cylinders. Spring-loaded check valves are provided for overcoming any imbalances that occur.

In the Kucera patent, there is disclosed a phasing circuit for serially connected hydraulic pistons, particularly of the type employed for the adjusting the fore and aft reel position of a combine harvester. At each end of each cylinder, there is provided in series a flow-restricting orifice and a check valve, parallel to the inlet connection.

A variety of hydraulic control mechanisms are found in U.S. Pat. Nos. 2,331,108 (Ganahl), 3,355,993 (Williamson), 3,603,210 (Florjancic) and 3,703,849 (Renner et al). These are not concerned with master and slave cylinder arrangements. An unusual hydraulic cross-regenerative circuit is disclosed in U.S. Pat. No. 2,940,262.

A variety of hoists are disclosed in U.S. Pat. Nos. 1,688,607 (Thielen), 2,644,307 (Blair) and 2,909,358 (Southerwick). These show that the use of hydraulic or pneumatic cylinders for hoists.

The U.S. Pat. No. 3,173,659 discloses a safety lift with an unusual catch arrangement on the cylinder itself.

SUMMARY OF THE PRESENT INVENTION

In accordance with the present invention, there is provided a lifting apparatus for lifting loads, the lifting apparatus comprising: first and second posts for mounting on the ground; first and second carriages slidably mounted on the posts for generally vertical movement; a lifting member extending between and joined to the first and second carriages so as to travel up and down with the carriages; first and second load support means mounted on the first and second carriages beneath the lifting member for supporting a load beneath the lifting member; and first and second actuators mounted in the first and second posts and connected to the first and second carriages for driving the carriages.

Preferably, the actuators are hydraulic actuators and are connected in a master-slave relationship. Thus, the first hydraulic actuator can comprise a first cylinder secured to the first post and connected to a hydraulic power unit. A piston in the first cylinder divides one lower chamber connected to the power unit from another upper chamber. A hollow piston rod extends through the upper chamber and includes an opening in communication with the upper chamber. The piston rod is secured to the respective carriage, and a connection line is connected to a port at the top of the piston rod and is mounted on the lifting member. The second actuator then comprises a hydraulic cylinder having a piston and a hollow second piston rod. The connection line is again connected to the piston rod port at the top of the piston rod; here, the hollow second piston opens into the lower chamber of the cylinder. The upper chamber is vented to atmosphere.

For safety purposes, velocity fuses etc. can be provided. An additional mechanical safety mechanism can comprise first and second safety catches pivotally or otherwise mounted on the carriages, for engagement in openings or the like of the two posts. The catches can be linked by a cable running through the lifting member. Then, actuation of the lever to disengage the catch on one side will automatically disengage the catch on the other side, thereby eliminating the necessity for the operator to walk around to the other side of the apparatus to disengage the second catch. As a further measure of security, transparent covers are provided to enable the operator to visually inspect the engagement of the mechanical safety catches.

Another aspect of the present invention provides a lifting arm assembly, for use in a lifting apparatus, the assembly comprising an arm support member adapted for mounting on a carriage of a lifting apparatus; a support arm pivotally mounted at one end about a substantial vertical axis and extending horizontally out from the support member for supporting a load at the other end thereof; a first coupling formation provided on said one end of the arm; a locking member movably mounted on the support member and including a second coupling formation complementary to the first coupling formation for engagement therewith in one of a plurality of angular positions of the support arm to lock the angular position of the support arm, the locking member normally maintained in engagement with the support arm; a plunger movably mounted in the support member, extending below the support member and engaging the locking member, the plunger being displaceable upwards relative to the support member to disengage the locking member from the support arm.

This arrangement is intended to provide for automatic disengagement of the angular locking arrangement for the arms, when the apparatus is lowered.

BRIEF DESCRIPTION OF THE DRAWINGS

For a better understanding of the present invention and to show clearly how it may be carried into effect, reference will now be made, by way of example, to the accompanying drawings, in which.

DESCRIPTION OF PREFERRED EMBODIMENT

Figure 1:
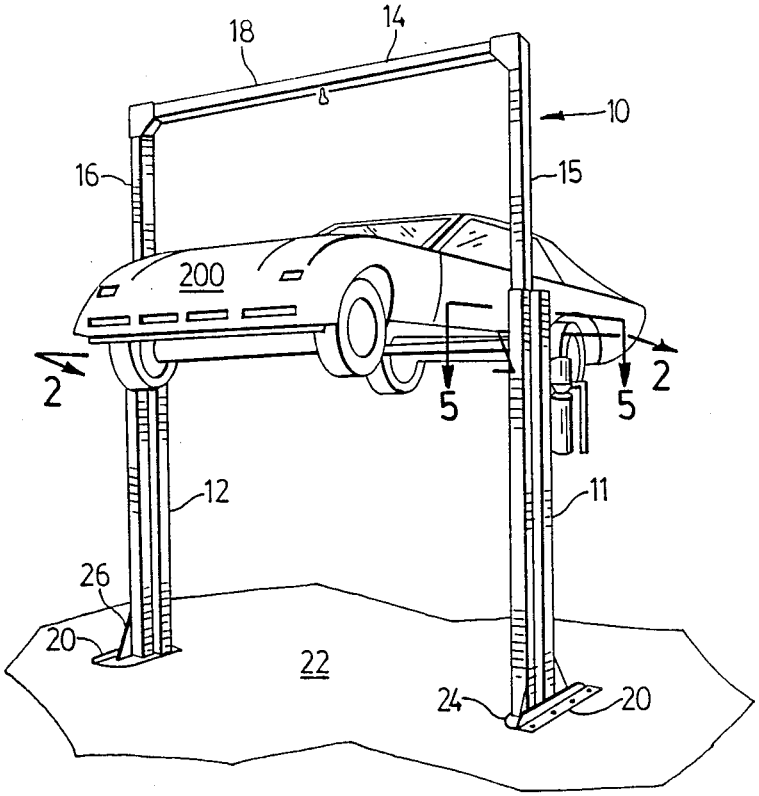
FIG. 1 is a perspective view of a lifting apparatus according to the present invention, shown in use with a car.

Referring first to FIG. 1, there is shown a lifting apparatus generally designated by the reference 10. The lifting apparatus 10 has driver and passenger side posts 11, 12. Slidably mounted in the posts 11, 12, as detailed below, is the lifting member 14, which comprises driver and passenger legs 15, 16 and a cross member 18. The legs 15, 16 are slidably mounted, by means of rollers as detailed below, in the posts 11, 12. L-shaped stabilizers 20 are provided at the bottom of the posts, to brace the posts 11, 12 and prevent them tipping forwards or backwards. The stabilizers 20 are secured to the surrounding floor 22 by, for example, bolts. Additionally, the lower end of the posts 11 include base plates 24 and strengthening pieces 26. The base plates 24 would also be secured to the floor, in known manner.

Figure 5:
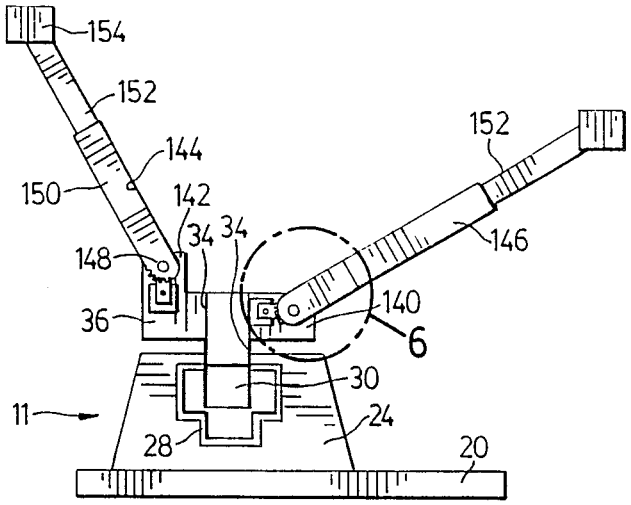
FIG. 5 is a plan view in the direction of the arrows 5—5 of FIG. 1.

Each of the posts 11, 12 is formed from three channel-section members which are welded together, to define a T-shaped slot 28 open on one side. The T-shaped slot 28 is open at the top of the T, opposite the leg thereof, and is best seen in FIG. 5.

Figure 2:
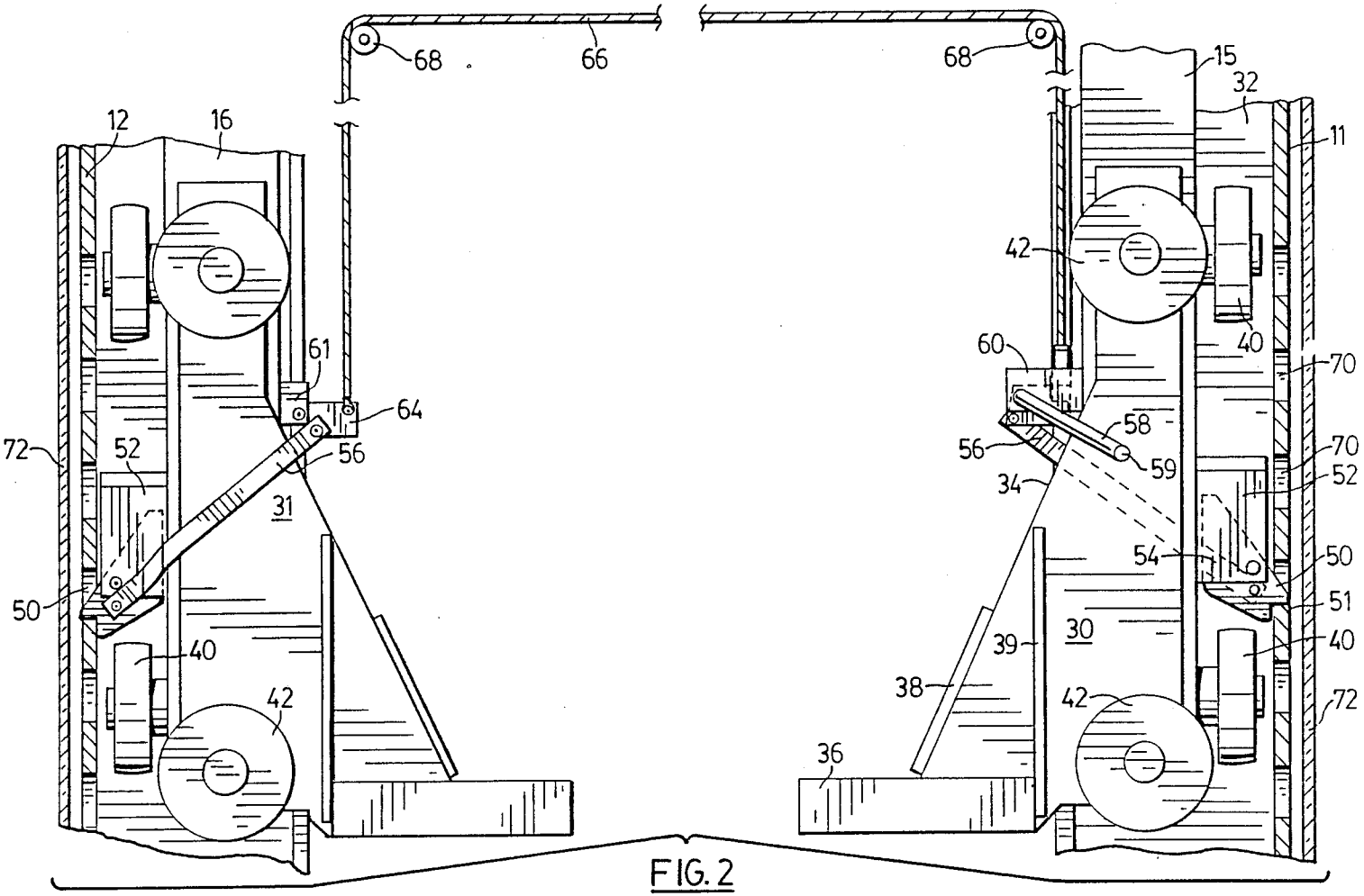
FIG. 2 is a view looking rearwards in the direction of the arrows 2—2 of FIG. 1 of part of the apparatus, in partial section.

Referring to FIG. 2, support carriages 30, 31 for the driver and passenger sides respectively are mounted in the channels of the posts 11, 12, the channels being designated by the reference 32.

The legs 15, 16 are formed from hollow generally square-section steel. Each support carriage 30, 31 comprises a pair of plates 34 secured to the bottom of the respective leg 15, 16 and extending outwardly towards the other support carriage. The plates 34 are generally triangular. For each support carriage 30, 31, a relatively thick arm support plate or member 36 is welded to the undersides of the plates 34. Additionally, a central strengthening plate 38 is welded between each pair of plates 34 and side strengthening plates 39 are welded between the plates 34 and the arm support plate 36. Details of the mounting of the arms on the arm support plate 36 are given below.

In most respects, the support carriages 30, 31 are generally symmetrical about a central plane of the apparatus. Each carriage 30, 31 includes three pairs of support rollers, which are arranged as a group of three upper support rollers and a group of three lower support rollers. Referring to the driver's carriage 30, on the outer side face of the carriage, there is a pair of rollers 40, which run in one channel of the post 11, corresponding to the downward leg of the T-shaped section. Forward rollers 42 engage in a forward channel of the post 11, whilst corresponding rearward rollers engage a rearward channel of the post 11 (the rearward rollers are not visible in FIG. 2, but the rearward and forward rollers are generally symmetrical about the plane of FIG. 2). Thus, the forward and rearward rollers 42 control the tilting of the driver side leg 15 in the plane of FIG. 2. The side rollers 40 control the forward and rearward tilting of the leg 15.

Corresponding rollers are provided for the passenger side. For brevity and clarity, these rollers, and other components common to the passenger and drivers sides of the apparatus 10 are given the same reference numerals, and the description is primarily in relation to the driver's side post 11.

A safety mechanism is provided, for providing a positive mechanical lock for the apparatus, at a number of different heights, spaced regularly along the height of the posts 11, 12. This is in addition to an hydraulic safety system described below.

The mechanical safety system comprises, for each side of the apparatus, a safety catch 50, pivotally mounted in a first bracket. The first bracket 52, comprising a pair of plates welded to the bottom of the leg 15, defines a slot in which the safety catch 50 is mounted. A pivot pin extends through the bracket 52 and safety catch 50, and a torsion spring 54 is provided for urging the safety catch 50 into the position shown. Thus, the safety catch 50 is secured to its shaft, and the torsion spring 54 exerts a counter clockwise torque on the shaft, for the drivers side safety catch 50. On the rearward side of the leg 15, a link 56 extends from the safety catch 50 to an actuating lever 58. The link 56 is pivotally connected to the safety catch 50, below its main pivot axis, and is also pivotally connected to a downward extension of the actuating lever 58. The actuating lever 58 is pivotally mounted about a longitudinal axis in a second bracket 60, secured to an inside face of the leg 15. The actuating lever 58 includes a handle 59. Consequently, downward pressure on the handle 59 causes the actuating lever 58 to rotate clockwise. This in turn pulls the link 56 away from the safety catch 50, causing the safety catch 50 to rotate clockwise.

For the passenger side, the safety catch 50, first bracket 52, torsion spring 54 and link 56 correspond with those for the drivers side. Here, the link 56 is provided on the forward side of the leg 16, so as to be visible in FIG. 2. The passenger side second bracket is given the reference 61, as it is somewhat smaller than the driver side second bracket 60. A crank arm 64 is pivotally mounted in the second bracket 61, and the passenger side link 56 is pivotally connected to it.

To link the passenger and drivers side safety catch is 50, a cable 66 is provided. The cable 66 extends up the two legs 15, 16 and through the cross member 18. At one end the cable 66 is pivotally attached to a side extension, that extends outwards, of the handle 58, whilst at the other end it is pivotally attached to the crank arm 64. Pulleys 68 are provided at the tops of the legs. Since the legs 15, 16, crossmember 18 and support carriages 30 all travel together, this arrangement can be used to actuate the safety catches 50.

Each safety catch 50 includes a cutaway portion defining a catch surface 51. Correspondingly, the side face of each post 11, 12 includes a series of rectangular openings 70 into which the safety catches 50 can extend. FIG. 2 shows the locked position in which the catch surfaces 51 about the bottom surfaces of a pair of openings 70.

Figure 3:
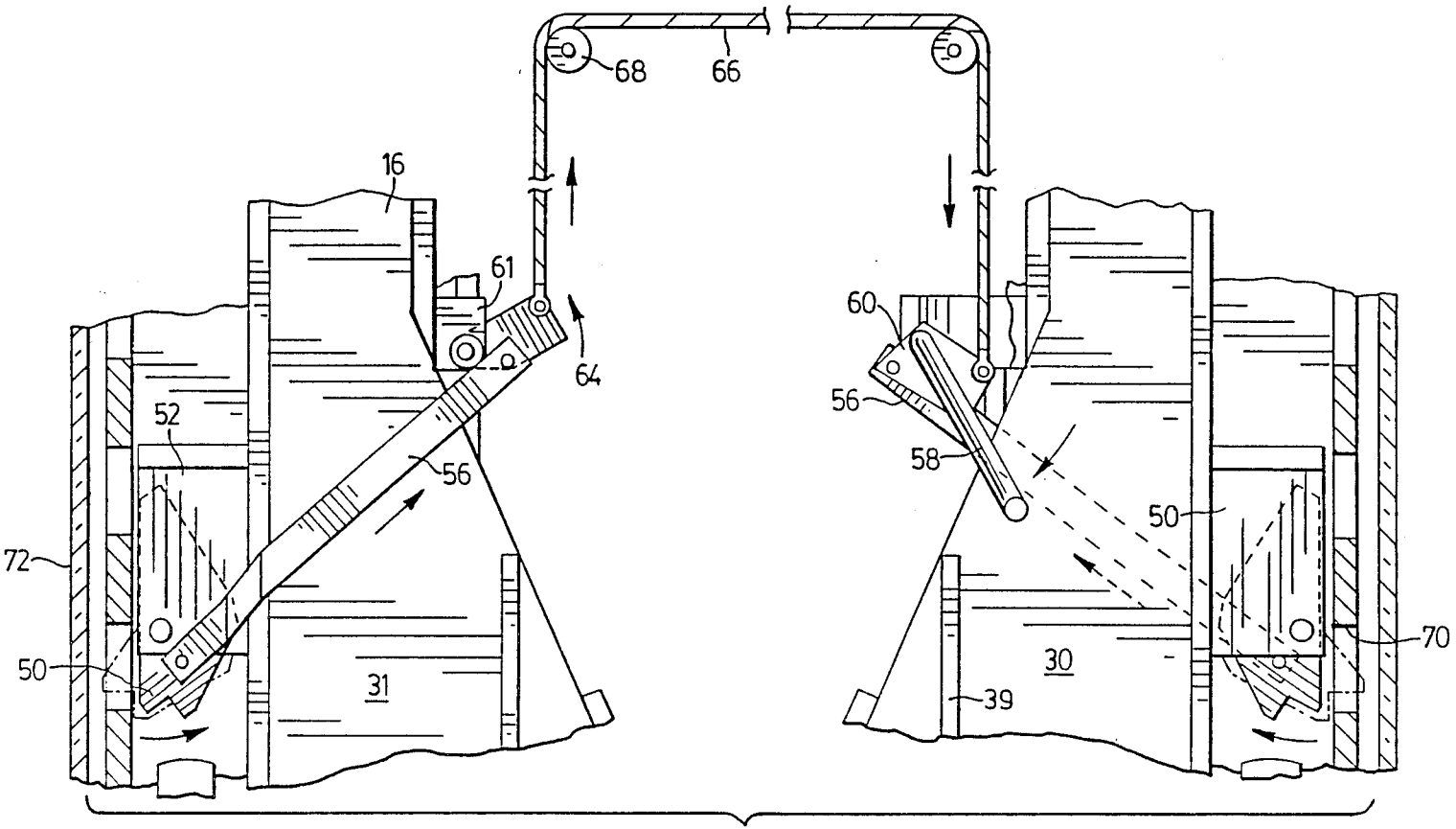
FIG. 3 is a view similar to FIG. 2 but only showing a part thereof and on a larger scale.

To release the safety catches 50, the handle 59 of lever 58 is pressed downwards. This, as mentioned above, rotates the actuating lever 58 clockwise, pulling the drivers side link 56 away from the drivers side safety catch 50. The drivers side safety catch 50 thus is pulled away from the openings 70, to the disengaged position shown in FIG. 3. Simultaneously, the movement of the actuating lever 58 pulls the cable up the passenger side leg 16, through the cross member 18 and down the drivers side leg 15. This motion similarly pulls the passenger side link 56 away from its respective safety catch 50, thereby pulling that safety catch 50 out of engagement (FIG. 3 includes arrows to show this motion).

To provide a visual indication of the engagement of the safety catches 50, transparent covers 72 are provided, through which the catches 50 can be inspected to ensure proper engagement with the openings 70.

Thus, a simple one handed motion on the handle 59 quickly disengages both safety catches 50 on both sides of the apparatus. The carriages 30 can then be raised or lowered as desired. When the handle 59 is released, the torsion springs 54 on both sides will urge the safety catches 50 against the posts 11, 12. As soon as the carriages 30 are lowered any distance, the safety catches 50 will spring into the adjacent openings 70, to lock the carriages 30 and prevent any further motion.

For upward movement of carriages 30, it is not necessary to release the safety catches 50 with the lever 58. The safety catches 50 will simply be pressed out of the way against the action of the torsion springs 54. However, for upward motion it is preferred to release the safety catches 50 manually, to reduce wear.

Figure 4:
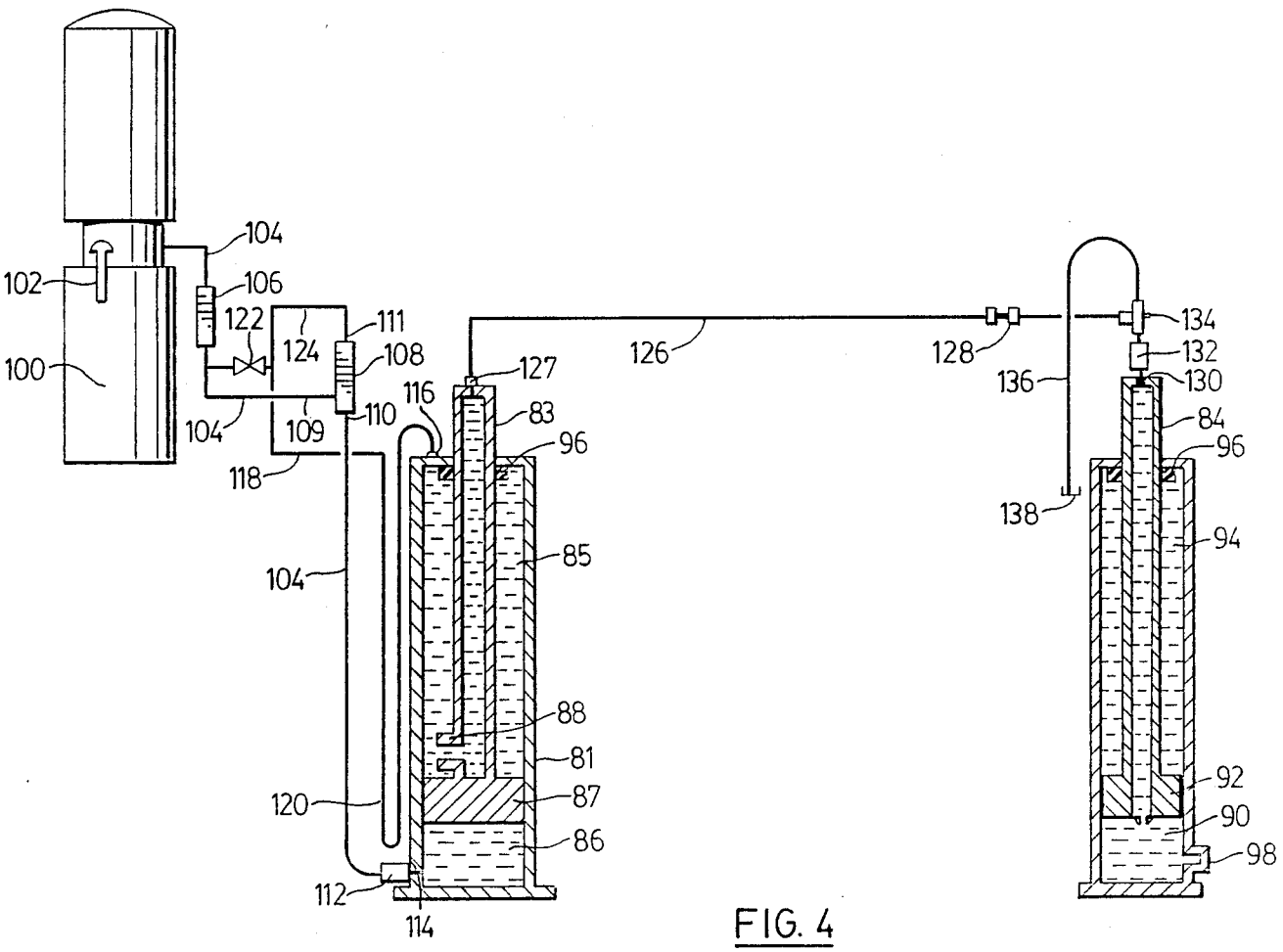
FIG. 4 is a schematic of the hydraulic circuit of the apparatus.

Referring to FIG. 4, within each post 11, 12, there is a respective hydraulic cylinder 81, 82, the hydraulic cylinder 81 being located on the drivers side and the hydraulic cylinder 82 being located on the passenger side. The hydraulic cylinders 81, 82 include hollow piston rods 83, 84, which are connected to and drive the legs 15, 16. The hydraulic cylinder 81 has one lower chamber 86, and another, upper chamber 85, both completely filled with hydraulic fluid and separated by a piston 87. A port or opening 88 in the hollow piston rod 83 provides communication between the interior of the piston and the upper chamber 85. In the passenger side hydraulic cylinder 82, the interior of the hollow piston rod 84 opens into one lower chamber 90. Here, in the cylinder 82, the piston 92 has a cross sectional area equal to that of the annulus of the upper chamber 85 in the drivers side cylinder 81, ie. equal to the effective upper working area of the drivers side piston 87.

Another upper chamber 94 of the cylinder 82 is vented to atmosphere. Appropriate seals 96 are provided for the hydraulic cylinders 81 around the pistons thereof.

An hydraulic power unit or pack 100 is provided, and this is mounted on the drivers side post 11. The hydraulic power pack 100 includes an electric drive motor, an hydraulic pump, and a tank for hydraulic fluid. It also includes an operating handle 102. The operating handle 102 is operated by simply moving it up or down. For convenience, the operating handle can include a long extension that is pivotally connected to the main part of the handle 102, with the extension simply hanging vertically downwards.

Extending from the power pack 100 is a main supply conduit 104, which comprises a $\frac{3}{8}$th of an inch diameter line. The main supply conduit 104 includes a flow control valve 106. The valve 106 is pressure compensated; it allows unlimited flow from the power pack 100, but limits the flow if the flow towards the power pack 100 to a certain maximum, irrespective of load.

The supply conduit 104 then extends through a pilot-operated check valve 108. The pilot-operated check valve 108 has an inlet 109, an outlet 110 and a pilot inlet 111.

The outlet 110 is connected by a further portion of the main conduit 104 to a first velocity fuse 112. The velocity fuse 112 is provided at a cylinder port 114 to the lower chamber 86 of the drivers side cylinder 81.

At the top of the upper chamber 85 there is a connection port 116, which is connected to a bypass line 118. The bypass line 118 is of $\frac{1}{4}$ inch diameter and includes a loop 120 extending down to adjacent the first velocity fuse 112. The other end of the bypass line 118 is connected via a bypass valve 122 to the main supply conduit 104, immediately between the flow control valve 106 and the pilot-operated check valve 108. A pilot pressure line 124 also connects the bypass line 118 and the bypass valve 122 to the pilot inlet 111 of the check valve 108.

A connection line 126 extends from a piston rod port 127 of the drivers side piston 83. The connection line 126 includes a connector 128 for assembly purposes.

The piston rod port 130 of the passenger piston 84 is connected to a velocity fuse 132, which in turn is connected to a T fitting 134 that has one inlet connected to the connection line 126, whilst the other inlet of the T fitting 134 is connected to a bleed line 136 closed by a plug 138.

The lower chamber 90 of the passenger side cylinder 82 is closed as indicated at 98.

The bypass line 118 and the bypass valve 122 are used to ensure that the pistons of the two cylinders are at the same height and for bleeding purposes during installation. Thus, when installing the apparatus, the main conduit 104 between the check valve 108 and the velocity fuse 112 is initially left disconnected at the check valve 108, with both the main conduit and check valve closed off at that point. The bypass valve 122 is opened as is the plug 138 of the bleed line. The power pack 100 is operated to flush hydraulic fluid through the connection line 126 and passenger side cylinder 82, until clear fluid is flowing.

The bleed plug 138 is then securely closed. The passenger side cylinder is then raised and lowered approximately 8 inches a number of times. This helps to flush out any air in the upper chamber 85 of the driver side cylinder, and possibly elsewhere not previously flushed out.

The conduit 104 is then connected to the outlet 110 of the pilot operated check valve 108. The bypass valve 122 is closed. The power pack 100 is operated to lift both cylinders together up and down a matter of approximately 6 inches; again this is repeated a number of times. This has the effect of flushing out the lower chamber 86 of the drivers side cylinder 81, and associated line portions.

The valve 122 is otherwise only used to correct any imbalances between the two cylinders 81, 82. In order to ensure that it is not inadvertently operated, it is provided with a removable handle, which is removed and stored safely after bleeding since it is not used during regular operation.

The velocity fuses 112, 132 close if the flow exceeds a certain level. Thus, they serve to sense any rupture in the associated lines, which would lead to an immediate surge in fluid flow. This would result in the relevant velocity fuse closing, preventing collapse of the lifting apparatus. The pilot-operated check valve 108 essentially monitors the pressure in the connection line 126. If this falls below a certain level then the check valve closes, to prevent any further fluid flow from the lower chamber 86. Thus, if the line 126 is ruptured, the velocity fuse 132 will close, to prevent collapse of the passenger side cylinder 82. Simultaneously, the loss of pressure will be transmitted to the pilot-operated check valve 108 which will close, to ensure also that the cylinder 81 is prevented from collapsing. The rate at which the pistons 83, 84 can be lowered is limited by the flow control valve, irrespective of the load on the pistons 83, 84.

Detailed description of the mode of operation of the whole apparatus including the hydraulic cylinder FIG. 4 follows below, after a description of the lifting arms in FIGS. 5–8.

Referring first to FIG. 5, there is shown the drivers side post 11. FIG. 5 shows in greater detail the arm support plate 36. As shown, the plate 36 comprises a main elongate portion 140 and a side extension 142 at the front thereof.

Forward and rear support arms 144, 146 are pivotally mounted via pivots 148 to the front side extension 142 and to the rear of the main elongate portion 140 respectively. The arms 144, 146 are similar in many ways. Each arm includes an inner arm part 150 and an extension part 152, which are of generally square section with the extension part 152 slidably received within the inner arm part 150. A support pad 154 is pivotally mounted on the free end of the extension part 152. In known manner, the support pad 154 can be provided with a suitable cushioning pad, or adaptor pads for different vehicles etc. The principal difference between the forward and rear arms 144, 146 is in the length. The rear arm 146 is longer then the forward arm 144, to compensate for its different pivot location. The length is such that each arm can be extended to approximately the same lateral position.

For each arm, there is provided a locking mechanism 160 for locking the arm in position. This is necessary to ensure that the arm stays in the right position as it is being raised to contact a vehicle, and to ensure that a vehicle is securely held. The locking mechanisms 160 are substantially identical and are described in relation to the locking mechanism 160 for the rear arm 146, shown in detail in FIGS. 6, 7 and 8.

Inner arm part 150 is of generally hollow square section, and is cut away to leave upper and lower flanges 162, 164, engaging the plate 36. The inner end of the upper flange 162 is formed as a toothed sector 166, centered on the pivot pin 148.

A locking member 168 is pivotally mounted by a horizontal pivot pin 170 to a support body 172 mounted on the plate 36. The locking member 168 includes a knob 174.

A plunger 176 is slidably mounted in a vertical bore 178 in the plate 136. A washer 180 is retained by a circlip 182 on the lower end of the plunger 176. A helical compression spring 184 acts between the washer 180 and the bottom of the plate 3, to urge the plunger 176 downwards. At its upper end, the plunger 176 is pivotally connected by a small pin 186 to the locking member 168, with the upper end of the plunger 176 accommodated in a recess in the locking member 168.

The locking member 168 includes a toothed end surface 188, for engaging the toothed sector 166 of the arm.

Figure 7:
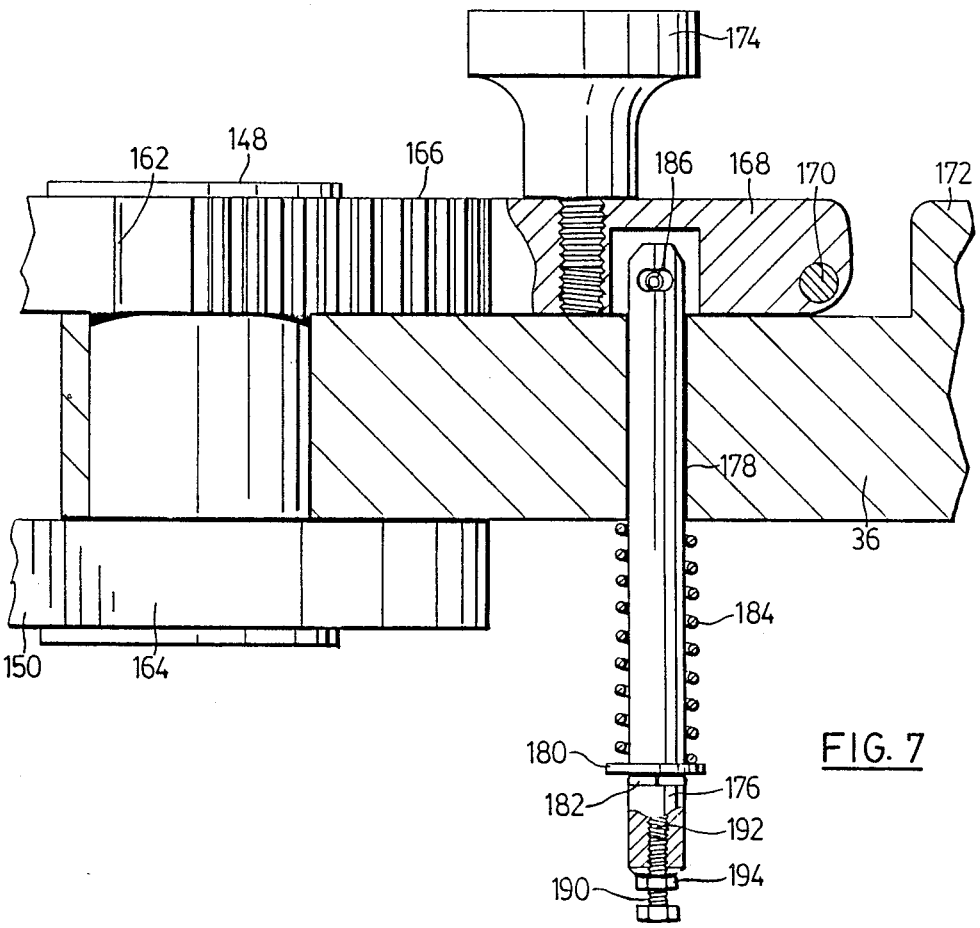
FIG. 7 is a view in the direction of the arrows 7—7 of FIG. 6.
Figure 6:
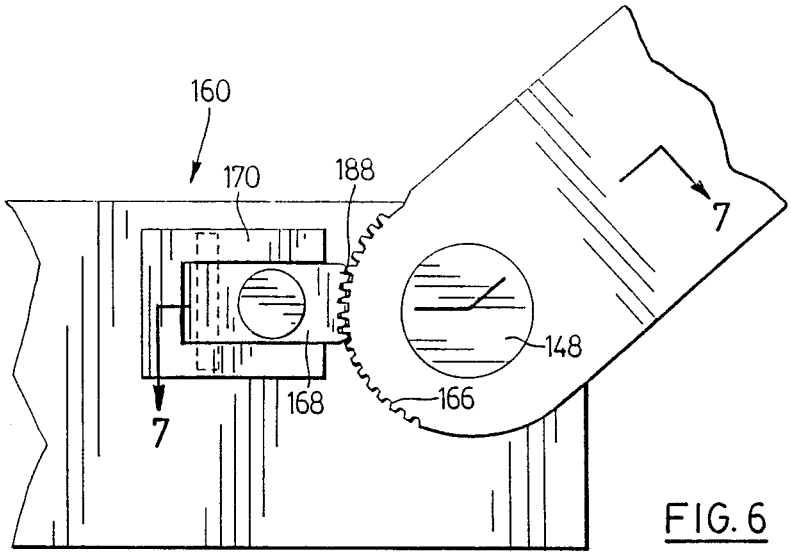
FIG. 6 is the detail 6 of FIG. 5 shown on an enlarged scale.

Thus, as shown in FIGS. 6 and 7, the spring 184 normally urges the plunger 176 downwards. This holds the locking member 168 pressed against the plate 36, in engagement with the toothed sector 166.

Figure 8:
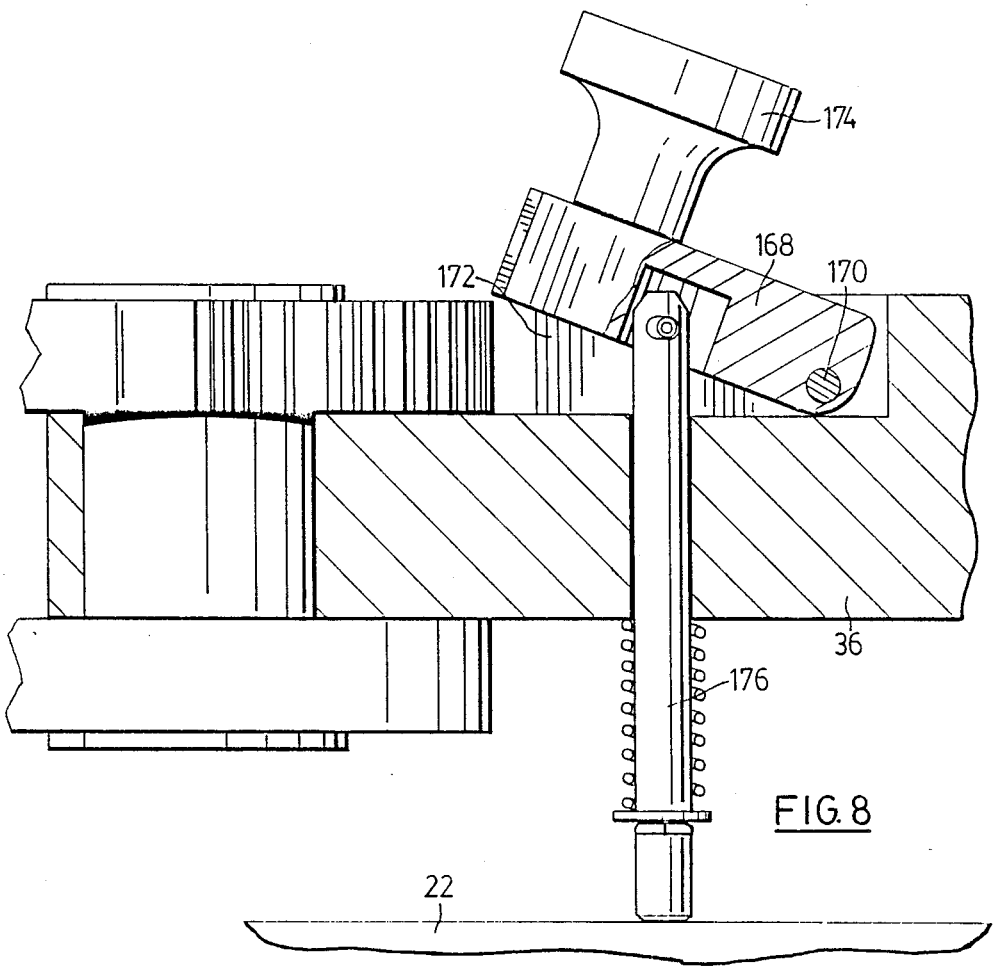
FIG. 8 is a view, similar to FIG. 7 when in a fully lowered position.

To adjust the angular position of the rear arm 146, the knob 174 is grasped and lifted upwards, as shown in FIG. 8. This releases the toothed sector 166, so that the arm can be rotated to the desired angular position. The spacing of the teeth on the toothed angular sector is selected, to give the desired number of different angular positions. Once the arm 146 has been moved to the desired angular position, the knob 174 can be released, to permit reengagement of the locking member 168. The length of the arm 146 can be adjusted by sliding the extension part 152 in and out, so that the support pad 154 can be positioned as required for a particular vehicle.

The plunger 176 is provided, to provide automatic release of the locking mechanisms 160 when the lifting apparatus is lowered. In FIG. 8, the floor is designated at 22. After finishing work on a vehicle, the lifting member 14 would be displaced downwards using the hydraulic mechanism. When the vehicles wheels touch the ground 22, then its weight will be taken off the arms 144, 146. However, the carriages 30, 31 are driven down further, until the plungers 176 contact the ground 22. The plungers 176 then urge the all four locking members 168 upwards, to release the arms. The arms 144, 146 can then be swung out of the way from beneath the vehicle. The vehicle can then be driven out from beneath the lift.

In practice, the floor 22 for many installations may be quite uneven. To allow for this, the plungers 176 are made adjustable. This is effected simply by providing a bolt 190, for each plunger 176, which is received in a threaded bore 192 at the bottom of the plunger 176. Additionally, a lock nut 194 is provided. Thus, when first setting up the lifting apparatus 10, the bolts 190 are adjusted for the plungers 176, so that they are all actuated simultaneously on lowering the apparatus. They are then locked in position with their lock nuts 194, for subsequent operation.

To briefly describe the overall sequence of operation, to lift a vehicle, an operator first ensures that the lifting member 14 is in its lowermost position, so that the plungers 176 are holding the locking members 168 in a raised or disengaged position. All four arms 144, 146 can then be swung rearwards, out of the way of a vehicle path between the posts of the apparatus. It is for this reason that the support plates 36 include the side extensions 142, to permit the forward arms 144 to be swung until they are parallel to the rear arms 146.

A vehicle 200 can then be driven between the posts 11, 12. The arms 144, 146 are then swung out and extended or retracted as desired to bring their support pads 154 into desired locations beneath the vehicle body or chassis. The power pack 100 is then operated to lift the lifting member 14. If necessary, it is lifted just a short way to bring the support pads 154 adjacent, but still spaced, from the support points on the vehicle 200. This should ensure that the locking members 168 engage to lock the arms 144, 146 in position. At this point, the operator can, if desired, check the orientation of the arms and adjust if desired. Thus, as the arm is now raised from the floor, each arm would have to be individually unlocked by manual operation of its locking member 168 to adjust its angular position.

The power pack 100 is then further operated to lift the vehicle to the desired height. During the lifting operation, the hydraulic pump forces fluid through the main conduit 104 into the lower chamber 86 of driver side cylinder. As this cylinder rises, fluid is displaced from its upper chamber 85 into the passenger side hydraulic cylinder 82 so that this rises at the same rate.

During the raising operation, the lever 58 can be actuated, to maintain the safety catches 50 disengaged. However, it is possible that the catches 50 can be left to simply ride over the portions separating the opening 70 until the desired height is reached. Once the vehicle is at the desired height, the actuating lever if grasped is released. The apparatus is then lowered slightly, to ensure that the safety catches 50 are engaged. If desired, the operator can then make a visual inspection on both sides through the transparent covers 72, to ensure that they are indeed properly engaged.

The necessary work can then be carried out on the vehicle. The operator can be confident that in addition to the safety catches 50, there are the hydraulic safety fuses 112, 132 and pilot-operated check valve 108, to lock the apparatus if there should be any major fluid leak.

To lower the apparatus, the operator releases the locking catches 50 by pressing down on the handle of the lever 58. If necessary, the lifting member 14 can be raised slightly first to free the locking catches 50. With the catches 50 maintained disengaged, the power pack 100 is operated to lower the lifting member 14. During the lowering operation, the operator has to keep one hand on the lever 58, and one hand controlling the power pack 100. This should ensure that the operator gives full attention to the lowering operation, and is not distracted. When the vehicle 200 reaches the floor 22, again the plungers 176 contact the floor 22 and raise the locking members 168, freeing the arms 144, 146. The arms can then be readily swung rearwards out of the path of the vehicle's wheels. The vehicle 200 is then driven out from under the apparatus 10.

The provision of the cross member 14 between the carriages 30, 31 has an additional advantage; it can be used to lift objects, eg. engines, transmissions, etc. For this purpose, the lifting member 14 is given the necessary strength and is provided with a hook 198. Then to remove a vehicle engine for example, the vehicle is rolled between the posts 11, 12. After removal of the hood and other ancillary components, removal of engine mounting bolts etc., the hook 198 is attached to the engine by a cable or the like. The arms 144, 146 are left swung to one side. The cross member 14 is then lifted, so as to lift the engine from the vehicle. The engine can be similarly replaced.

I claim:

1. A lifting apparatus for lifting loads, the lifting apparatus comprising: first and second posts for mounting on the ground; first and second carriages slidably mounted on the posts for generally vertical movement; a lifting member extending between and joined to the first and second carriages so as to travel up and down with the carriages; first and second load support means mounted on the first and second carriages beneath the lifting member for supporting a load beneath the lifting member; an hydraulic power unit; a first hydraulic actuator which is a master actuator and comprises a first cylinder, a first piston separating two first chambers from one another within the first cylinder, a cylinder port opening into one first chamber, a first hollow piston rod secured at one end to the first piston and extending through said other first chamber and out from the first cylinder and including at said on end an opening into the other first chamber and a first piston rod port at the other end thereof, wherein one of the first cylinder and the first piston rod is secured to the first post with the hydraulic power unit connected to respective one of the cylinder port and the first piston rod port, and the other of the first cylinder and the first piston rod is secured to the first carriage, and a connection line is provided secured to the lifting member and connected to the other cylinder port and the first piston rod port; and a second hydraulic actuator which is a slave actuator and comprises a second cylinder, a second piston in the second cylinder separating two second chambers from one another, a second piston rod, with an hydraulic connection being provided between the connection line and one second chamber, and with the second chambers sized so that the first and second carriages are displaced at substantially equal rates in the same direction.

2. An apparatus as claimed in claim 1, wherein both hydraulic actuators are arranged so that extension of the hydraulic actuators drives the carriages upwards, and wherein the connection line is connected to the lowermost one of the two second chambers.

3. An apparatus as claimed in claim 2, wherein, for the first hydraulic actuator, the first cylinder is secured to the first post, the hydraulic power unit is connected to the cylinder port, the first piston rod is secured to the first carriage and the first piston rod port is connected to the connection line, and wherein, for the second hydraulic actuator, the second cylinder is secured to the second post, the second carriage is secured to the second piston rod, and the second piston rod is hollow and opens at one end into said one second chamber and is provided with a second piston rod port at the other end thereof connected to the connection line, said other second chamber being vented to atmosphere.

4. An apparatus as claimed in claim 3, which includes first and second safety catches movably mounted on the first and second carriages respectively, and each of the first and second posts includes respective engagement means with which the respective first or second catch can engage to lock the respective carriage, and wherein a mechanical link is provided on the cross member connecting the first safety catch to the second safety catch, the mechanical link including an actuating lever on the first carriage, enabling simultaneous disengagement of both the first and second safety catches.

5. An apparatus as claimed in claim 4, wherein the lifting member comprises respective legs extending upwards from the carriages and a cross member extending between upper ends of the legs, and which includes pulleys at junctions between the legs and the cross member and wherein the mechanical link comprises a cable pivotally connected to each of the first and second catches and extending over those pulleys, each of the first and second catches being pivotally mounted to the respective first or second carriage.

6. An apparatus as claimed in claim 5, which includes a first velocity fuse mounted at the cylinder port of the first hydraulic actuator and a second velocity fuse mounted to the second piston rod port of the second hydraulic actuator, which velocity fuses close in response to excessive fluid flow, and wherein a pilot-operated check valve is provided between the hydraulic power unit and the first velocity fuse, the pilot-operated check valve including a pilot inlet connected to the connection line between the first and second hydraulic actuators.

7. An apparatus as claimed in claim 6, wherein the engagement means for each of the first and second posts comprises a generally vertical row of openings, and wherein each of the first and second safety catches is spring biased for engagement with the openings of the respective post, and wherein each post includes a transparent cover covering up the row of openings of that post, the transparent cover enabling the engagement of the respective safety catch with the openings of that post to be observed.

8. An apparatus as claimed in claim 3, wherein a velocity fuse is provided at the cylinder port of the first cylinder and a velocity fuse is provided at the second piston rod port of the second hydraulic actuator, the velocity fuses closing in response to excessive flow rates.

9. An apparatus as claimed in claim 8, wherein the hydraulic power unit is connected to the first cylinder by a main conduit, which includes a pilot-operated check valve, the pilot-operated check valve having a pilot inlet connected to the connection line, so as to be responsive to pressure in the connection line between the first and second hydraulic actuators.

10. An apparatus as claimed in claim 9, wherein the pilot inlet is connected to the connection line by a by-pass line and which includes a by-pass valve connected between the main conduit and the by-pass line, for bleeding purposes, and wherein the connection line adjacent the second hydraulic actuator includes a bleed line.

11. An apparatus as claimed in claim 8, 9 or 10, wherein the main supply conduit includes a pressure-compensated flow control valve, which permits unlimited flow from the hydraulic power unit, but which restricts flow to the hydraulic power unit to a certain maximum rate.

12. An apparatus as claimed in claim 1, wherein each of the first and second carriages includes respective first and second safety catches moveably mounted thereon, and wherein the first and second posts include engagement means, with which the first and second safety catches can engage to secure the first and second carriages, and wherein a mechanical link is provided extending between the first and second safety catches and mounted on the lifting member, the mechanical link including a first actuation lever mounted on the first carriage, which enables both the first and second safety catches to be disengaged simultaneously.

13. An apparatus as claimed in claim 12, wherein the lifting member comprises respective legs extending upwards from the carriages and a cross member extending between upper ends of the legs, and wherein each of the safety catches is pivotally attached on the respective carriage, and the mechanical link comprises a cable, which is pivotally mounted at either end to the first and second safety catches and which extends up either leg and through the cross member, pulleys being provided at the junctions of the legs and the cross member for the cable.

14. An apparatus as claimed in claim 13, wherein each safety catch is pivotally mounted to an outside face of a respective carriage, wherein for the first carriage, the actuation lever is pivotally mounted on an inner face of the first carriage and is pivotally connected to a respective end of the cable and a first link is provided pivotally connecting the actuating lever to the first safety catch, and wherein for the second carriage, a crank arm is pivotally mounted on the inside face of the second carriage and is pivotally connected to the respective end of the cable and a connection link is pivotally connected between the crank arm and the second safety catch.

15. An apparatus as claimed in claim 12 or 13, wherein each of the first and second posts includes a transparent cover covering the respective engagement means and enabling engagement of the respective safety catch with the engagement means to be observed.

16. An apparatus as claimed in claim 12 or 13, wherein the engagement means of each of the first and second posts comprises a series of openings extending in a vertical row along the respective post, and each safety catch is spring biased for engagement in an opening of the respective post.

17. An apparatus as claimed in claim 16, wherein each of the first and second posts includes a transparent cover covering the openings thereof, which transparent cover enables the engagement of the respective safety catch with an opening to be observed.

18. An apparatus as claimed in claim 3, 12 or 6, wherein each of the first and second load support means comprises a pair of extensible support arms pivotally mounted on the respective first or second carriage and extending generally horizontally out therefrom.

19. An apparatus as claimed in claim 18, wherein, for each support arm, there is provided a locking member movably mounted on the corresponding carriage, the locking member and the respective support arm including complementary coupling formations for engagement with one another, biasing means urging the locking member into engagement with the support arm to lock the angular position thereof, and a plunger means movably mounted on the carriage for engagement with the locking member, the plunger means extending below the carriage and being displaceable upwards relative to the carriage to disengage the locking member from the support arm.

* * * * *